United States Patent [19]

Johnson et al.

[11] 4,252,448

[45] Feb. 24, 1981

[54] HEAD CLEANING APPARATUS FOR ELECTRORESISTIVE PRINTER

[75] Inventors: Richard E. Johnson, Los Altos; Robert B. Taggart, Sunnyvale, both of Calif.

[73] Assignee: Computer Printers International, Mountain View, Calif.

[21] Appl. No.: 26,646

[22] Filed: Apr. 3, 1979

[51] Int. Cl.[3] ..... B41J 3/12; B41J 3/16; B41F 35/00

[52] U.S. Cl. ..... 400/119; 400/701

[58] Field of Search ..... 400/119, 679, 701, 702, 400/702.1; 15/21 B, 38; 346/155, 162–164; 101/423, 425

[56] References Cited

U.S. PATENT DOCUMENTS

| | | | |
|---|---|---|---|
| 2,715,360 | 8/1955 | Brown | 400/119 X |
| 3,826,915 | 7/1974 | Giolitti et al. | 400/119 X |
| 4,195,937 | 4/1980 | Baran | 400/120 |

OTHER PUBLICATIONS

IBM Tech. Disclosure Bulletin, "Typewheel Brush", by J. E. Drejzaetal, vol. 19, No. 11, Apr. 1977, pp. 4122–4123.

*Primary Examiner*—Paul T. Sewell
*Attorney, Agent, or Firm*—Limbach, Limbach, & Sutton

[57] ABSTRACT

A non-impact printing system in which a multi-wire head collects debris has an arrangement for cleaning the head with a brush by sweeping the head over the brush in a first direction and immediately sweeping the head back over the brush in the reverse direction, while simultaneously pulling the head away from the brush.

Certain aspects of the preferred embodiment disclosed herein include inventive subject matter set forth in the copending application of Robert Burdett Taggart, Ser. No. 26,647, filed Apr. 3, 1979, entitled, "Printing Apparatus Drive System".

8 Claims, 13 Drawing Figures

HEAD CLEANING APPARATUS FOR ELECTRORESISTIVE PRINTER

BACKGROUND OF THE INVENTION

The invention relates generally to the cleaning of multi-wire heads of the type used in non-impact printing systems such as electroresistive printers and more particularly to a novel arrangement in which a head and brush are moved relative to each other in such a way as to provide effective removal of debris collected by the head wires during the writing operation.

Non-impact printers, particularly of the electroresistive type, are widely used in high speed printing systems particularly those associated with computers. In an electroresistive printing system the writing medium is typically a special paper which has a thin aluminum film which is engaged by the multi-wire printing head. Electric current is passed selectively through the printhead wires in order to burn off areas of the aluminum coating to produce the desired writing. By the time a multi-wire printhead has traversed the width of the aluminized writing surface it typically has collected debris which must be removed in order to preserve clear writing in the subsequent line. Various brush arrangements and the like have been employed in the prior art in order to clean the head of collected debris, however, it has been found that the straightforward passage of a writing head over a brush is not sufficient to adequately clean multi-wire heads.

SUMMARY OF THE INVENTION

In accordance with the teachings of the present invention a novel head cleaning arrangement is provided in which the head is carried past the edge of the aluminized paper subsequent to having written on the paper for one line, where it encounters a pivoted and spring-biased brush which engages the printhead. The head pushes the brush backward along an arc and passes across the brush at which time the direction of the printhead is reversed while simultaneously beginning to withdraw the head backward away from the brush, thus providing a final sweeping away of the debris as the head begins its retrace to resume its position at the opposite end of the writing paper to begin printing a further line. The brush comprises a multiple bristle bundle in which the bristle diameters are larger than the smallest wire to wire spacing of the head wires in order to prevent the bristles from catching in the head wires. In one specific embodiment of the invention a head wire spacing of three thousandths of an inch is employed with a bristle diameter of five thousandths of an inch.

DETAILED DESCRIPTION OF THE PREFERRED EMBODIMENT

Figure 1:
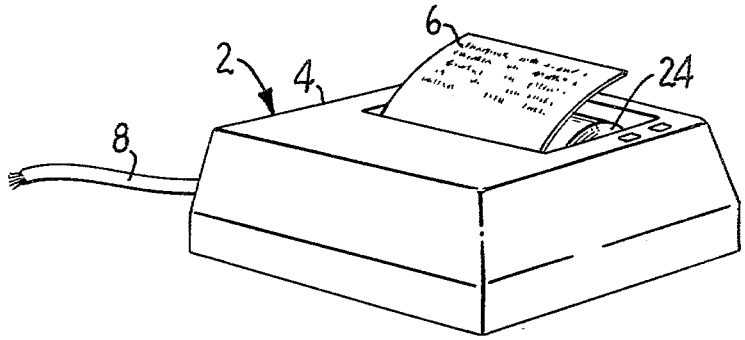
FIG. 1 is a perspective view of a non-impact printing system embodying the present invention.

FIG. 1 shows a perspective view of the non-impact printing device 2 with its cover 4 in place. The apparatus prints information on the paper 6. A line cord 8 provides power to the device. In the embodiment described the printer is an electroresistive type printer, although certain aspects of the invention are applicable to other types of printers.

Figure 2:
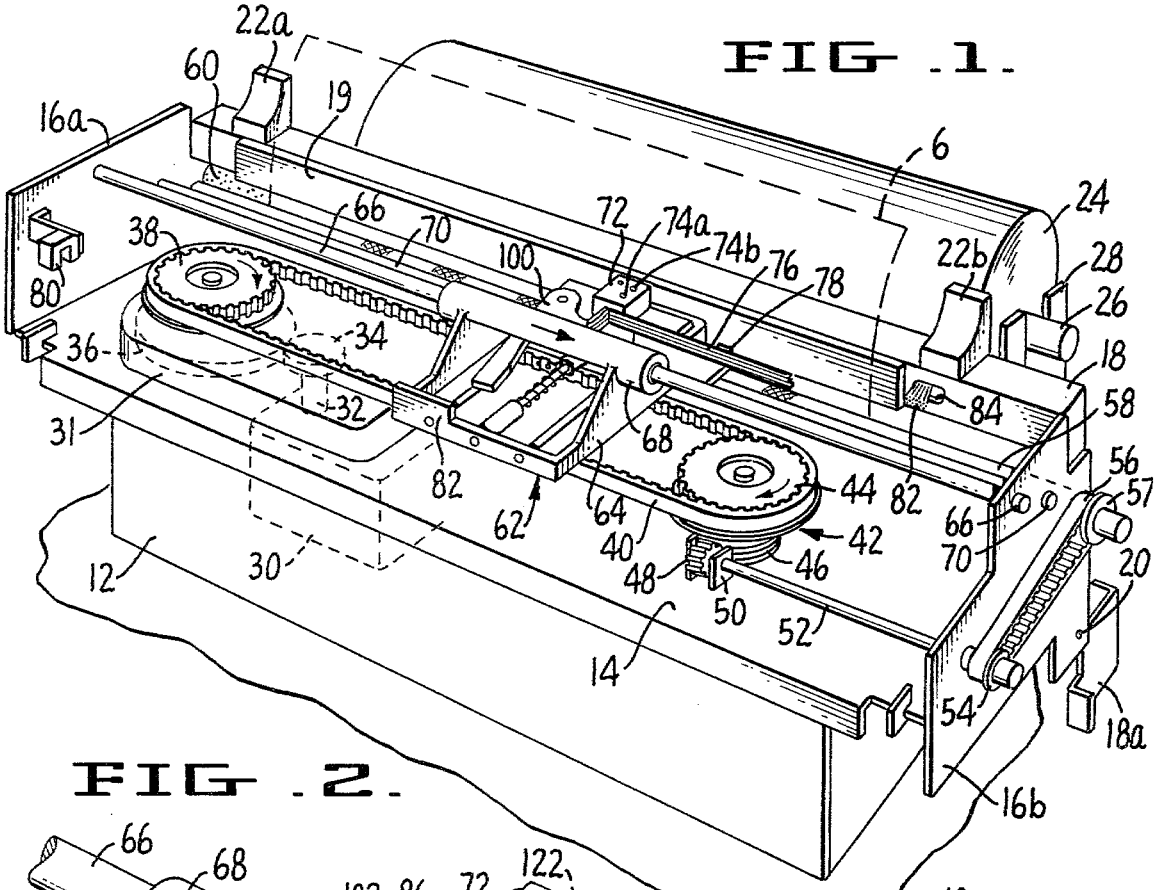
FIG. 2 is a fragmentary perspective view of the device of FIG. 1 with the cover removed.

The remaining figures show details of the printer 2 with the cover 4 removed. FIG. 2 shows generally the principal mechanical elements of the printhead drive and paper advance system. The bottom cover 10 serves as the support for a rectangular drive assembly support enclosure 12 on which a printing drive assembly base 14 is mounted. Base 14 has end supports 16A and 16B. A releasable platen assembly 18, carrying a resilient platen 19, is pivoted at pivot 20 on the end supports 16A and 16B. The lower portion of the releasable platen assembly is designated 18A. Thumb tabs 22A and 22B are fixed to the releaseable platen assembly for use by the operator of the device. A paper roll 24 on shaft 26 is supported by shaft supports 28. Motive power is provided by a motor 30, which is preferably an inexpensive single direction non-reversible motor, such as a shaded pole AC induction motor. A cover 31 is provided over the top of the motor on drive assembly base 14. Motor 30 has a drive shaft 32 fixed to a drive wheel 34 which engages a drive pulley 36 which is in turn fixed to the ribbed belt drive wheel 38 which is driven clockwise. A belt 40, which may be formed of polyurethane with cloth cords, for example, and which has ribs matching those of the belt drive wheel in order to provide a positive non-slipping drive relationship, extends from drive wheel 38 to a matching ribbed wheel 44. Wheels 38 and 44 are disposed near the left and right ends, respectively, of the lateral area across which the printhead is to be driven. A worm gear assembly 42 is associated with the wheel 44 such that a worm gear 46 turns with wheel 44 and drives a helical gear 48 held by support bracket 50. The helical gear is connected to a drive shaft 52 that turns a ribbed pulley 54 which in turn drives a ribbed paper advance roller pulley 57 via a ribbed belt 56 similar to belt 40. Pulley 57 is attached to the paper drive roller 58 which is stainless steel and has a plurality of knurled segments along its length. A resilient idler pinch roller 60 engages the drive roller when the platen release assembly 18 is in its forward position. Paper 6 from supply roll 24 is driven between rollers 58 and 60.

Figure 8:
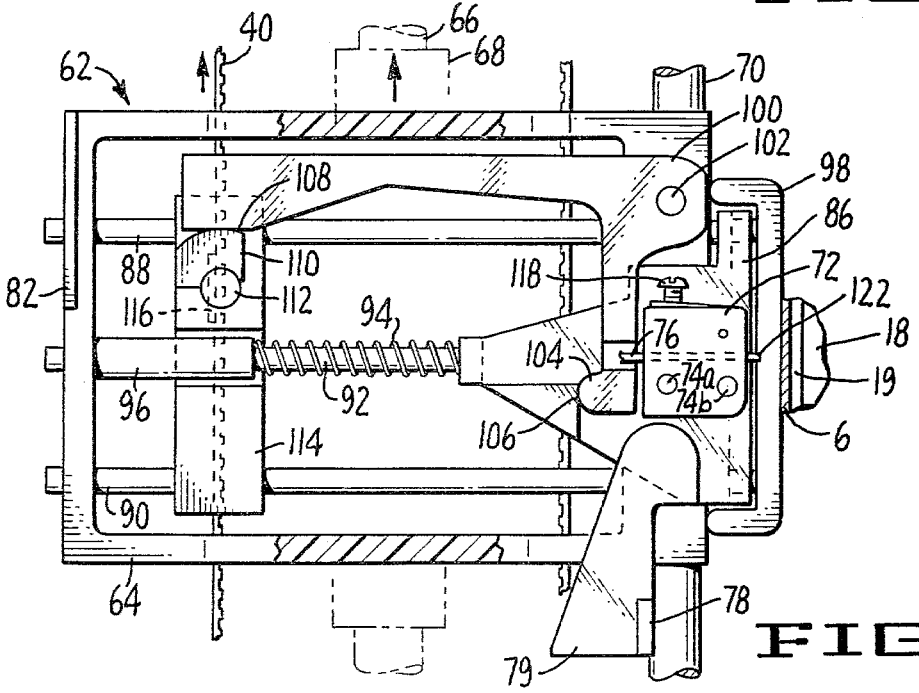
FIG. 8 is a top plan view of the head carriage assembly showing the head in its retracted position.
Figure 9:
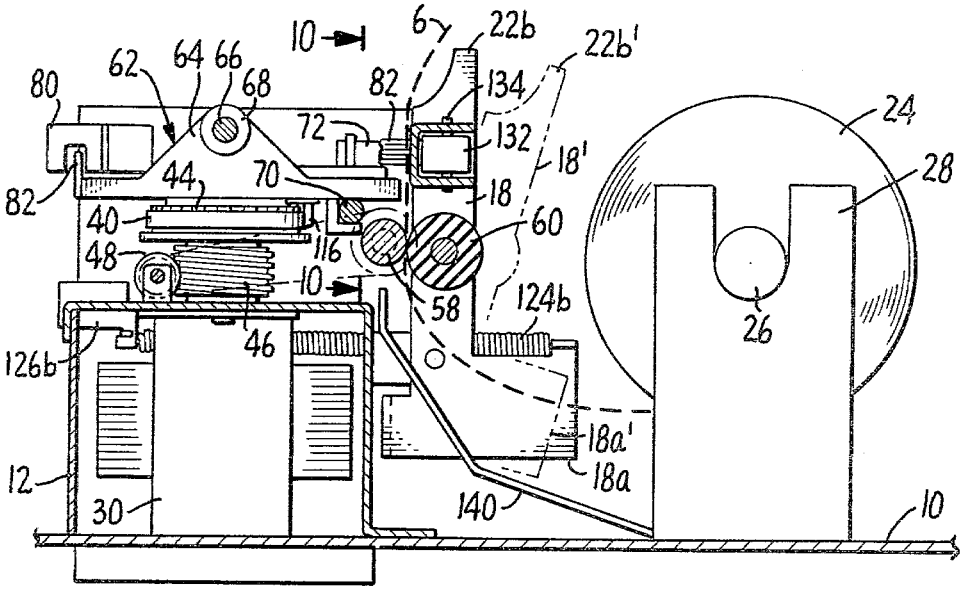
FIG. 9 is a fragmentary side elevational view showing the principal paper drive elements.

The printhead carriage assembly 62 has a base 64 that rides on an overhead support rod 66 and a forward support rod 70 that are held at their ends by the end supports 16A and 16B. Base 64 has a portion 68 that circles the overhead support rod 66. A printhead support block 72 slips over mounting pins 74A and 74B that extend from the front portion of the carrier 86. A plurality of leads in a flat printed circuit type ribbon 76 extend from the printhead support block 72 rearward of the block and then to the right where a lead positioning finger 78, which extends from the carrier 86, holds the flexible lead ribbon away from the paper 6. Finger 78 is supported by a member 79, shown in FIGS. 3, 6 and 8, which is fixed to the base 74.

Still referring to FIG. 2, a home position sensor 80 is mounted from the left side support 16A. The sensor can be of the photoelectric type such that when the carriage 62 is at the left extremity of its travel a tab 82 passes into the U-shaped open portion of the sensor 80. A head-cleaning brush 82, which is described in greater detail below, extends through an aperture 84 in the platen release assembly 18 at the right-hand extremity of the head carriage movement.

Figure 3:
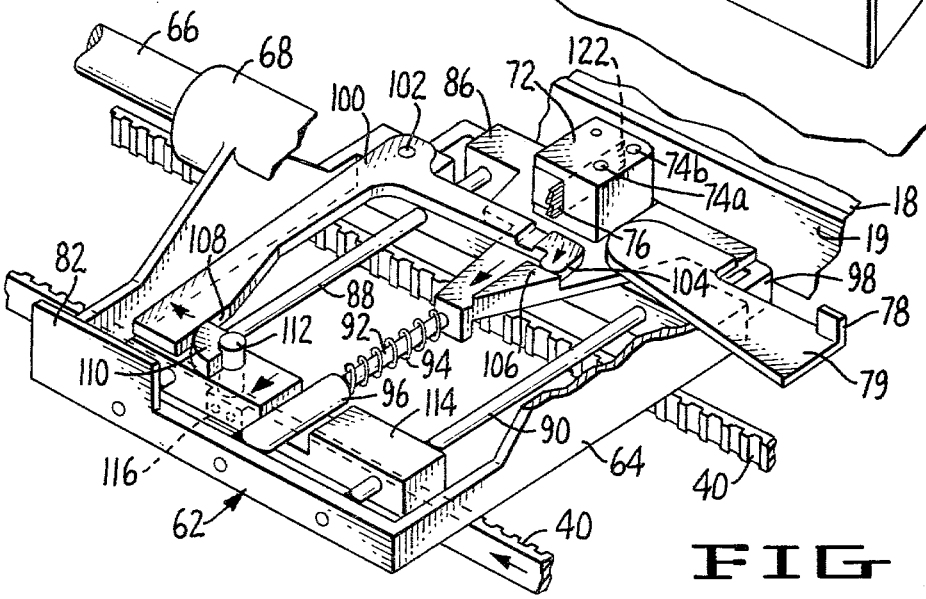
FIG. 3 is a partially cut away fragmented perspective view of the printhead carriage assembly.
Figure 4:
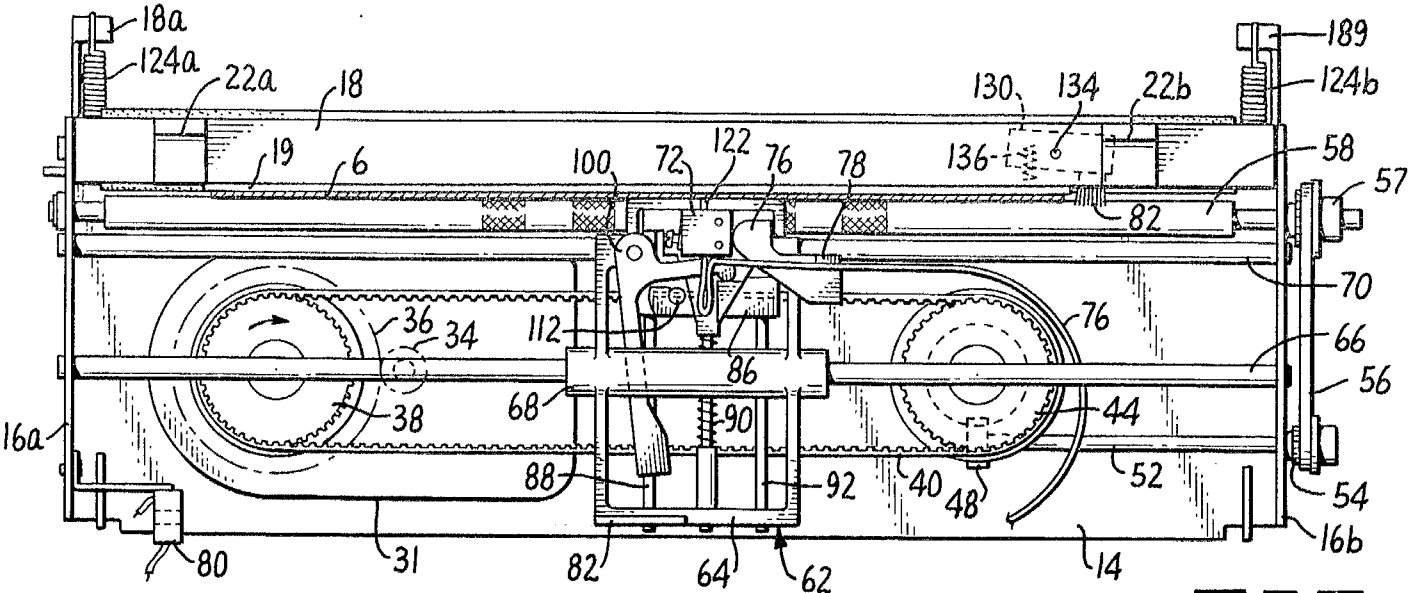
FIG. 4 is a top plan view of the principal mechanical assemblies of the device of FIG. 1.
Figure 5:
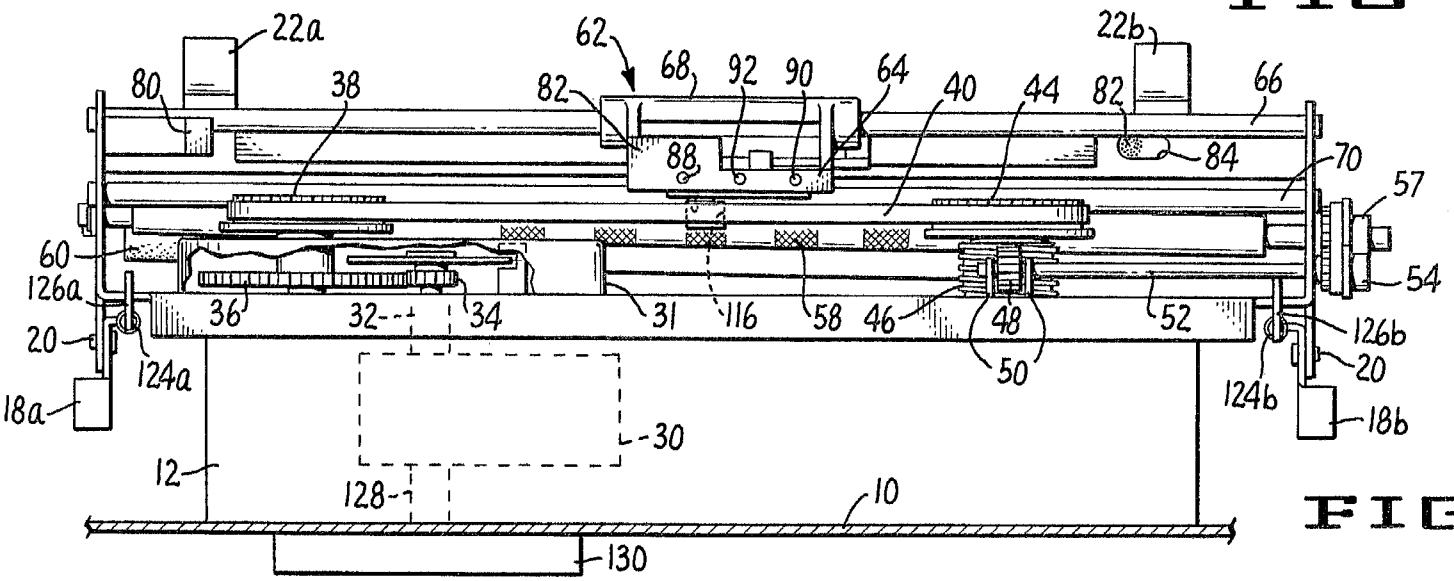
FIG. 5 is a front elevational view of the principal mechanical features of the device of FIG. 1.
Figure 6:
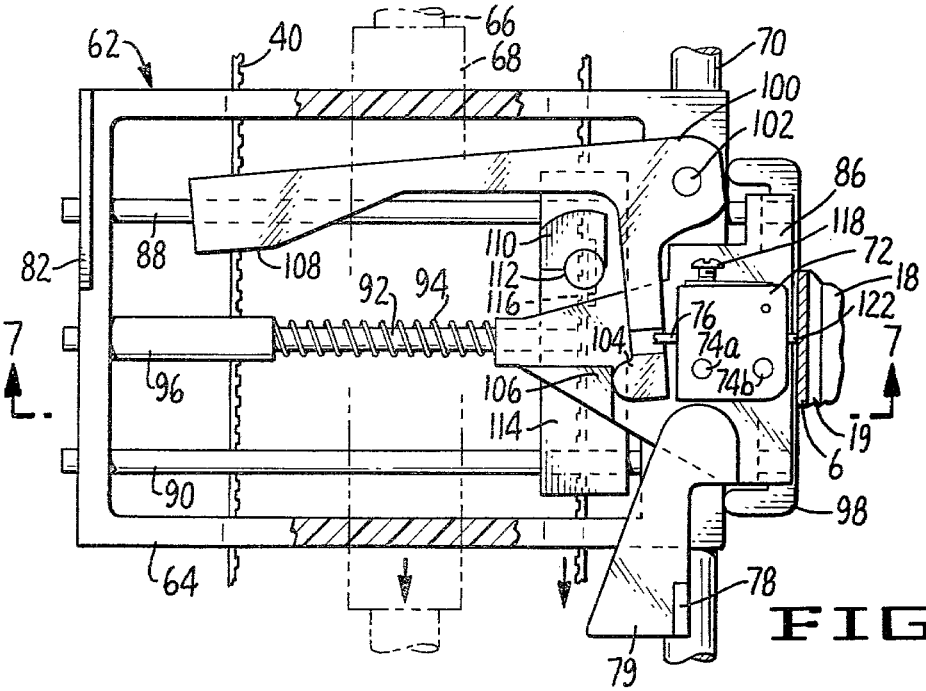
FIG. 6 is a top plan view of the printhead carriage assembly showing the head in its extended position.
Figure 7:
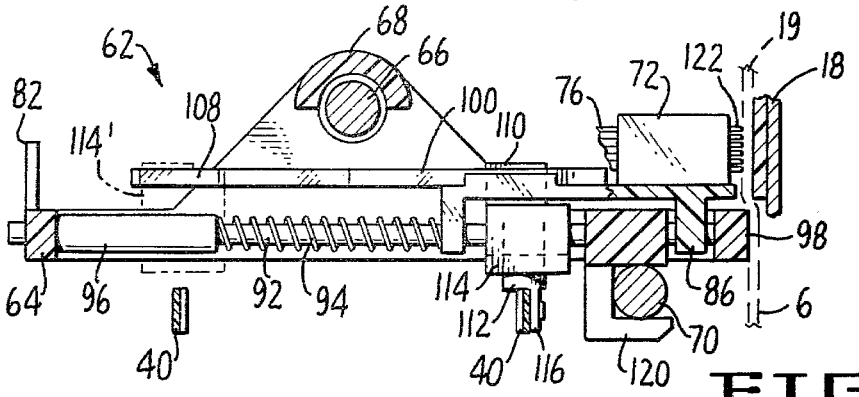
FIG. 7 is a sectional side elevation view of the head carriage assembly showing the head extended.

Referring now to FIGS. 3, 6, 7 and 8, the head carriage assembly 62, shown in greater detail. The printhead support block 72 is mounted on a generally V-shaped carrier 86 that slides on support rods 88, 90 and 92. Rod 92 has a spring 94 that biases the head forward toward the platen 19. A cylindrical spacer 96 slips over the rear portion of rod 92. An elongated U-shaped member 98 is fixed to the front of the carriage base 64 in order to push against the paper 6 below the level of the platen 19 so as to put a slight bend in the paper as it comes over the platen from below, thereby assuring better head to paper contact. An L-shaped cam lever 100 is pivoted at pivot 102. One end of the cam lever at 104 engages a surface 106 of the printhead support block carrier 86 in order to move the carrier 86 backward against the force of the spring 94. The other end of the lever 100 has a cam surface 108 that engages cam 110 carried by pin 112 which is fixed to the cam carrier 114 that slides on rods 88 and 90. Pin 112 rotates in an aperture in the cam carrier 114 and is attached to a tab 116 that is sewn or otherwise permanently attached to the belt 40. This is best seen in FIGS. 3 and 7.

The head block 72 has a screw 118 that engages the leads 76 to which a plurality of tungsten printhead wires 122 are attached. In FIG. 7 the forward support rod engaging finger 120 is best seen.

In operation the printhead carriage assembly slides along rods 66 and 70 by virtue of the attachment of pin 112 to the drive belt 40. In FIG. 6 the carriage assembly is shown with the cam carrier in its forward position which causes the printhead block and printhead 122 to be biased against the paper and platen by the force of spring 94. This is also shown by the solid line position of the cam carrier 110 in FIG. 7. As the drive belt 40 continues to move clockwise the carriage assembly eventually reaches the right-hand pulley 44 and the tab 116 moves backward so as to slide the cam carrier 114 rearwardly, causing the cam 110 to engage the cam surface 108 of lever 100, thus pulling the head assembly rearwardly away from the paper 6 as the head assembly returns to the left side of the paper.

Referring now to FIGS. 4, 5, 9 and 10 wherein other details of the preferred embodiment are shown, the platen release springs 124A and 124B are fixed at one end to tabs 126A and 126B on the base 14. The motor 30 has a further shaft 128 that drives a fan (not shown) located under a cover 130 on the bottom panel 10. Brush 82 is held by a brush mount block 132 that is pivoted at pivot 134. A spring 136 biases the brush 82 in a clockwise position. Operation of brush 82 is set forth in detail below in connection with the description of FIGS. 11, 12 and 13. A paper guide 140 extends from below the paper roll 24 to the vicinity of the paper drive rollers 58, 60.

Figure 10:
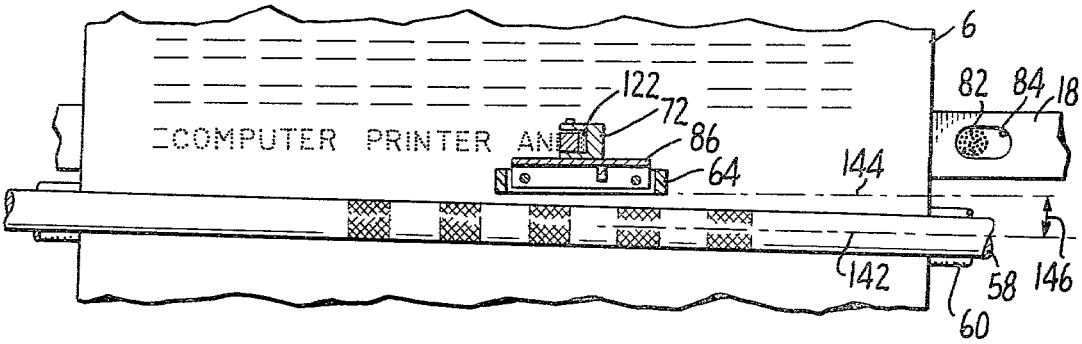
FIG. 10 is a fragmentary front elevational sectional view illustrating the angled paper drive rollers.

In operation, the paper drive roller 58 is driven continuously by the worm gear assembly and belt drive arrangement so that the paper is being advanced even as the printhead 122 is writing on the paper 6. It will be appreciated that the motor 30 runs continuously during operation of the apparatus, thus continuously driving the wheel 38 which in turn causes the printhead carriage assembly to continuously move back and forth while continuously advancing the paper. The configuration of the drive assembly is such that one complete two-way movement of the printhead carriage assembly results in the paper advancing by one line. In order to provide a printed product having straight lines across the paper 6, it is therefore necessary to compensate for the continual advancement of the paper by putting paper drive rollers 58 and 60 at an angle. Referring particularly to FIG. 10 line 142 is the center line of the paper rollers 58 and 60, whereas line 144 is a line perpendicular to the edges of the paper which corresponds to the desired straight line writing on the paper. An angle 146 between the straight line and the center line of the paper rollers is provided. In practice, the exact angle will depend on the rate of paper advancement versus longitudinal printhead carriage velocity.

Figure 11:
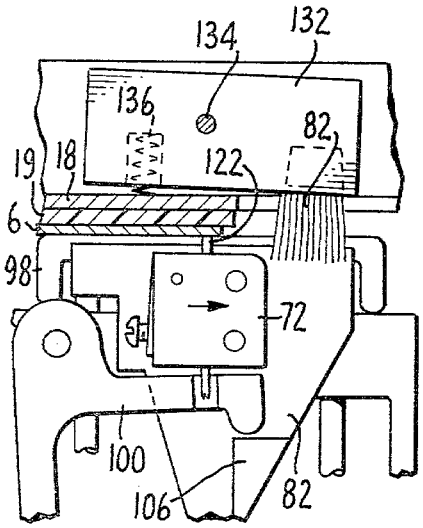
FIG. 11 is a fragmentary top elevational view showing the printhead approaching the cleaning brush.
Figure 12:
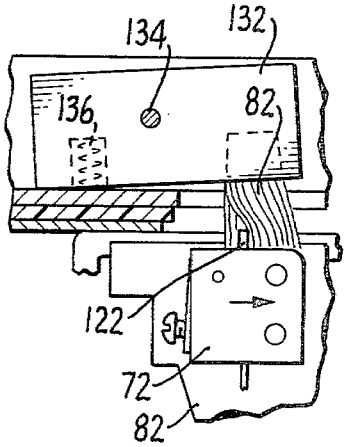
FIG. 12 is a fragmentary top plan view showing the printhead sweeping across the cleaning brush in a first direction.
Figure 13:
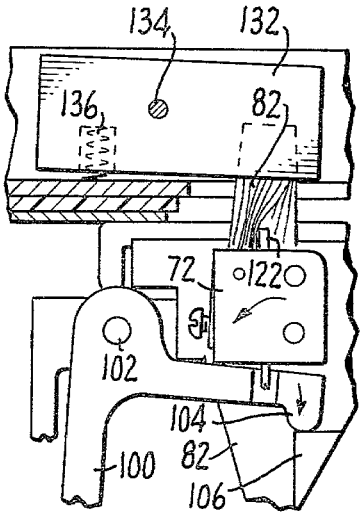
FIG. 13 is a fragmentary top plan view showing the printhead sweeping across the cleaning brush in a second direction.

Referring now to FIGS. 11, 12 and 13 wherein the details of the head brush cleaning operation are shown, the brush 82 includes a plurality of nylon filaments each having a circumference somewhat larger than the wire spacing of the head 122. For example, in one practical embodiment the wire to wire spacing in the head 122 was three thousandths of an inch whereas the brush bristle size was five one thousandths of an inch. In FIG. 11 the printhead 122 is near the right-hand extremity of the paper 6 and platen 19. At this point the cam carrier 114 is still in its forward position because the tab 116 is still riding on the portion of belt 40 closest to the paper and has not yet begun to "turn the corner" around wheel 44. Just as the head goes off the edge of the paper and begins to engage brush 82 as shown in FIG. 12, the tab carried by belt 40 begins to follow along the periphery of wheel 44. At the same time, the head remains forward because the cam carrier 114 has not moved sufficiently rearward to engage lever 100 and the head block 72 and head 122 push brush 82 rearward, causing it to pivot against the pressure spring 136. Thus, the brush acting with the force of spring 136 brushes in a first direction across the head 122. The head carriage assembly moves slowly and begins to reverse direction as the tab 116 is carried around the right periphery of wheel 144. The carriage assembly is already moving to the left and in the opposite direction back across brush 82 as the cam begins to engage lever 100 to retract the head 122. Thus, as the head moves to the left across brush 82 it is also withdrawing backward thus allowing the brush to pivot clockwise to some extent. The result of this configuration in operation is to provide a highly effective cleaning of the head 122 by passing it in two directions across the brush 82 and to provide a wiping away action as the head finally moves to the left away from the brush to thereby sweep away loosened debris from the head 122.

In practice, the printhead carriage assembly and associated parts may be preferably formed from a polycarbonate which is glass filled with some Teflon. This material has been found to be very stable when molded, with little or no tendency to deform. The resilient pinch roller and platen may be formed from rubber type materials such as neoprene.

A slotted disc of "pipper wheel" 33 fixed to the motor shaft 32 cooperates with sensor 35 to provide an electrical indication of the motor rotation for electronic control circuitry (not shown).

I claim:

1. In a non-impact printing system having a multi-wire head for writing on a medium resulting in the collection of debris on said head wires, a method for cleaning said head with a brush comprising sweeping said head over said brush in a first direction, and immediately sweeping said head back over said brush in the reverse direction while simultaneously pulling said head away from said brush.

2. The method of claim 1 further comprising pivotally biasing said brush in a direction generally perpendicular to the sweeping directions of said head.

3. The method of claim 2 wherein the pivot point is offset from said brush to pivot the brush in an arc away from the oncoming head moving in said first direction.

4. The method of claims 1, 2, or 3 further comprising providing a brush having bristle diameters larger than the smallest wire to wire spacing of said head wires.

5. In a non-impact printing system having a multi-wire head for writing on a medium resulting in the collection of debris on said head wires, a system for cleaning said head comprising a brush, means for sweeping said head over said brush in a first direction, and means for immediately sweeping said head back over said brush in the reverse direction while simultaneously pulling said head away from said brush.

6. The combination of claim 5 further comprising means for pivotally biasing said brush in a direction generally perpendicular to the sweeping directions of said head.

7. The combination of claim 6 wherein the pivot point is offset from said brush to pivot the brush in an arc away from the oncoming head moving in said first direction.

8. The combination of claims 5, 6, or 7 wherein the brush bristle diameters are larger than the smallest wire to wire spacing of said head wires.

* * * * *